US007067201B2

(12) United States Patent
Ellis et al.

(10) Patent No.: US 7,067,201 B2
(45) Date of Patent: Jun. 27, 2006

(54) WEAR RESISTANT COATING FOR KEEL JOINT

(75) Inventors: Fife B. Ellis, Houston, TX (US); Kim H. Phan, Cypress, TX (US); Eric J. Schultz, Katy, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 10/953,296

(22) Filed: Sep. 29, 2004

(65) Prior Publication Data

US 2005/0069654 A1 Mar. 31, 2005

Related U.S. Application Data

(60) Provisional application No. 60/506,793, filed on Sep. 29, 2003.

(51) Int. Cl.
*B32B 15/01* (2006.01)
*C22C 19/07* (2006.01)

(52) U.S. Cl. ..... 428/668; 428/679; 420/436

(58) Field of Classification Search ..... 428/679; 405/211, 224.3

See application file for complete search history.

(56) References Cited

U.S. PATENT DOCUMENTS 3,787,203 A * 1/1974 Yokota et al. ..... 420/440

OTHER PUBLICATIONS

Materials from Internet Website of Haynes International, Inc., dated Aug. 2003, http://www.haynesintl.com, 65 pages.

* cited by examiner

*Primary Examiner*—John J. Zimmerman
(74) *Attorney, Agent, or Firm*—Bracewell & Giuliani LLP

(57) ABSTRACT

A method of reducing stress and wear on one or more components in a keel joint assembly in which a cobalt-based, wear resistant alloy coating is applied to the surfaces of one or more components. The use of the coating reduces stress and wear and achieves improved corrosion, galling, erosion and abrasion resistance as compared to other currently known and applied methods. In the present invention, the coating would preferably would be applied to the surfaces of the mating components of the keel joint.

16 Claims, 1 Drawing Sheet

WEAR RESISTANT COATING FOR KEEL JOINT

RELATED APPLICATIONS

This application claims benefit from U.S. Provisional Application No. 60/506,793, filed Sep. 29, 2003.

BACKGROUND OF THE INVENTION

1. Technical Field

The present invention relates to offshore drilling and production platforms, and in particular to the application of a wear resistant coating to components of a keel joint used with such platforms.

2. Description of the Prior Art

In certain types of offshore oil or gas production wells, a riser assembly is used to connect a floating drilling and/or production platform with a stationary subsea wellhead. The riser assembly passes through an opening in the bottom of the platform. The riser is subject to bending movement where it enters the floating platform caused by wave action and the like. Such movement can result in stress on the components of the riser assembly. A keel joint is often used to absorb and reduce this stress. The keel joint typically includes a housing that surrounds a portion of the riser assembly. The housing includes mating keel joint components that flex or move relative to one another. The movement from the floating platform is translated to these mating surfaces. While the stress on the riser assembly may be reduced, typically there is a corresponding increase in stress on the mating components and other components of the keel joint.

The harsh environment can also cause wear to the keel joint components. Seawater, entrained sand, chemical contamination, mud and other damaging elements can corrode the component surfaces and result in unwanted galling, erosion and abrasion, as well as increase the likelihood of component degradation and eventual failure. These drawbacks are in addition to the stress and wear on the components caused by normal bearing loads and work requirements. Other offshore drilling and production components are also subject to similar conditions.

SUMMARY OF THE INVENTION

The present invention is directed to the application of a cobalt-based, wear resistant alloy coating to the surfaces of the offshore drilling and production components, particularly those in a keel joint, to reduce stress and wear and achieve improved corrosion, galling, erosion and abrasion resistance as compared to other currently known and applied coatings. In the present invention, the coating would preferably would be applied to the surfaces of the mating components of the keel joint.

DETAILED DESCRIPTION OF THE PREFERRED EMBODIMENT

Figure 1:
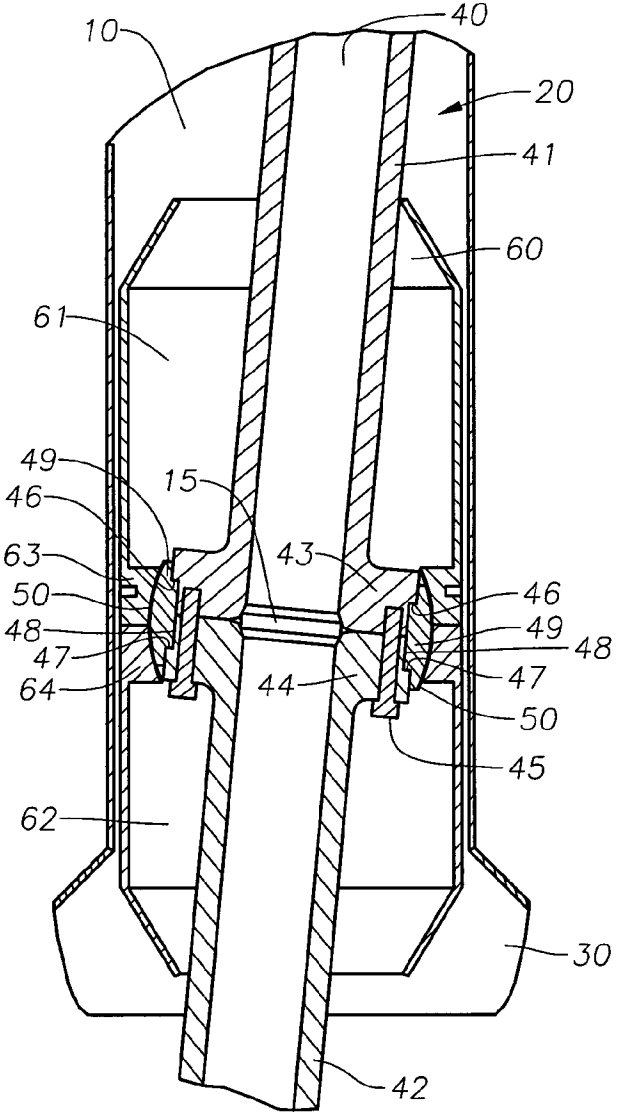
FIG. 1 is a sectional view of a keel joint housing surrounding a riser assembly with a bearing element.

FIG. 1 shows an example of a keel joint 20 located at the bottom of a tubular conduit 10 in an offshore platform. The keel joint 20 is generally comprised of a housing 60 which surrounds a riser assembly 40. Housing 60 extends a short distance below conduit 10 and a selected distance within conduit 10. Keel joint 20 serves to reduce bending stress where riser assembly 40 passes into platform conduit 10. Conduit 10 has a downward facing guide funnel 30. Keel joint 20 is submerged in the sea during normal use.

The riser assembly 40 includes a plurality of tubular individual riser segments, typically secured by threads. FIG. 1 shows a flanged connection point 15 between two individual riser segments. Flanged connection 15 forms a part of keel joint 20. An upper riser segment 41 has a mating flange 43. A lower riser segment 42 has a mating flange 44. The mating flanges 43, 44 of the upper 41 and lower 42 riser segments are held together by bolts 45.

The mating flange 43 of the upper riser segment 41 has an upper shoulder portion 46 on its outer diameter. The mating flange 44 of the lower riser segment 42 has a lower shoulder portion 47 on its outer diameter. An annular recess 48 is located between the upper 46 and lower 47 shoulder portions. A metallic bearing element 49 fits closely within recess 48, sandwiched between the shoulder portions 46, 47. The bearing element 49 has a spherical surface 50 along its outer diameter.

The housing 60 is sized so that platform conduit 10 may move slidingly up or down relative to housing 60. The housing 60 has an upper section 61 and a lower section 62. The upper section 61 has a lower mating metallic element 63. The lower section 62 has an upper mating metallic element 64. The mating elements 63, 64 each have an inner surface that is generally spherical in shape. The housing 60 has a generally vertically aligned interior portion.

When the housing 60 is assembled and surrounds the segment of the riser assembly 40, the generally curved-shaped inner surfaces of the upper and lower mating elements 63, 64 of the housing 60 closely fit with the outer spherical surface 50 of the bearing element 49 of the riser assembly 40 creating a flexible ball joint. It is within this ball joint region, i.e., upon the closely fitted surfaces of the bearing element 49 and the inner diameter of the mating surfaces 63, 64, where the majority of wear and stress within the keel joint 20 occurs, and where a wear resistant coating can provide the greatest benefit.

Figure 2:
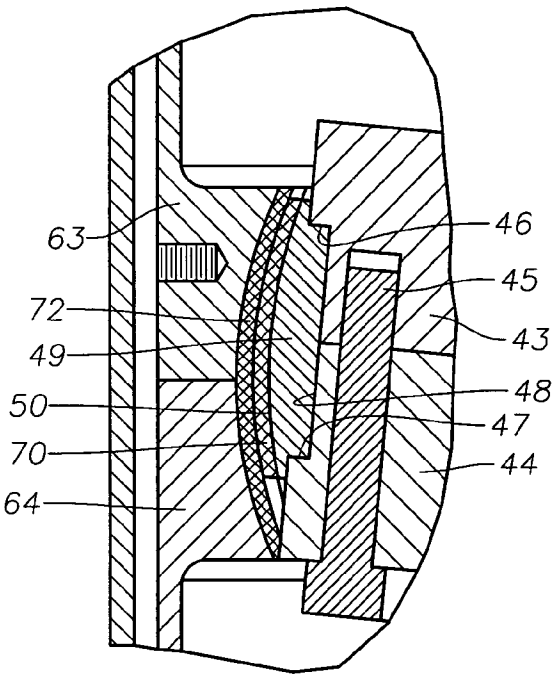
FIG. 2 is an enlarged sectional view of the encircled portion of FIG. 1 with an applied coating in accordance with this invention.

In the preferred embodiment of the present invention illustrated in FIG. 2, a first coating layer 70 is applied to the outer spherical surface 50 of the bearing element 49. A second coating layer 72 is applied to the inner surfaces of the mating elements 63, 64 of the housing 60. In general, and in accordance with the present invention, one or more layers of coating can be applied to any one or more of the surfaces of the keel joint 20 which can benefit from the coating's stress and wear resistant properties.

The coating can be applied to the surfaces of the keel joint 20 by a cladding process, which is preferably performed under high temperature and/or pressure conditions. The cladding process can involve, for example, a laser or tungsten inert gas ("TIG") welding process. Laser welding utilizes energy from a concentrated coherent light beam to melt and fuse metal. Tungsten inert gas welding utilizes energy produced by an electrical plasma arc to melt and fuse metal. The electrical arc is formed between a tungsten electrode and the work piece. Shielding gas is used to protect the weld pool and electrode from the atmosphere. A filler rod is dipped into the molten pool or a filler wire is continuously fed into the molten pool.

Laser welding is the preferred process because of lower manufacturing costs and because laser welding is a faster process than TIG. The width of the coating layer tends to be larger for laser welding (up to 1 inch for laser versus about 0.25 inch for TIG). Also, laser welding provides lower weld metal dilution than the TIG process and the travel speeds are greater for laser welding. Lower weld metal dilution means that a thinner weld layer is required to achieve a corrosion resistant chemistry. For example, it is possible to achieve a maximum iron dilution of 12% with the laser process at a clad thickness of 0.025 inch. On the other hand, the same iron dilution requirement takes a minimum clad thickness of 0.050 inches with a TIG welding process. This is important in keel joint applications, which require both wear and corrosion resistance, because a smaller clad thickness is required to achieve the required corrosion resistance properties. This potentially reduces the number of weld passes required.

The preferred coating of the present invention is a wear-resistant, cobalt-chromium-nickel alloy with high tensile strength, when compared to stainless steels, and good resistance to aggressive, oxidizing and reducing substances. A preferred coating is marketed under the trademark Ultimet® by Haynes International, Inc. of Kokomo, Ind. Preferably, the Ultimet® alloy contains, by weight percent, approximately 23.5–27.5% chromium, 7.0–11.0% nickel, 4.0–6.0% molybdenum, 1.0–5.0% iron, 1.0–3.0% tungsten, 0.1–1.5% manganese, 0.05–1.00% silicon, 0.03–0.12% nitrogen, 0.02–0.10% carbon and the remainder cobalt. Also, the coating may optionally contain no more than 0.030% phosphorus, no more than 0.020% sulfur and no more than 0.015% boron. In one embodiment, the Ultimet® alloy contains, by weight percent, approximately 54% cobalt, 26% chromium, 9% nickel, 5% molybdenum, 3% iron, 2% tungsten, 0.8% manganese, 0.3% silicon, 0.08% nitrogen and 0.06% carbon.

In an alternate embodiment, the coating is a wear-resistant, cobalt-chromium-nickel alloy preferably containing, by weight percent, approximately 26.0–29.0% chromium, 8.0–12.0% nickel, 3.0–5.0% molybdenum, 0.4–1.0% tantalum, no more than 2.0% iron, 3.0–5.0% tungsten, no more than 1.0% manganese, no more than 1.0% silicon, 0.12–0.20% carbon and the remainder cobalt.

Combining the relative percentages of the common components of two previous examples yields the following: 23.5–29.0% chromium, 7.0–12.0% nickel, 3.0–6.0% molybdenum, 1.0–5.0% iron, 1.0–5.0% tungsten, **0.1–*l*.5**% manganese, 0.05–1.0% silicon and 0.02–0.20% carbon, and an amount of cobalt.

In certain embodiments, the amount of nitrogen, sulfur, boron and/or phosphorus in the coating may be regulated in order to avoid weld quality problems associated with use of the alloy. For example, excess nitrogen in the weld filler increases the probability of solidification cracking. In certain embodiments, if nitrogen is added, it shall not exceed, by weight percent, 0.090%. High levels of phosphorus, boron and/or sulfur tend to segregate grain boundaries and cause embrittlement, which results in increased cracking sensitivity, reduced fracture toughness and lower Charpy V Notch impact values. In certain embodiments, if phosphorus is added, it shall not exceed, by weight percent, 0.030%. In certain embodiments, if sulfur is added, it shall not exceed, by weight percent, 0.020%. In certain embodiments, if boron is added, it shall not exceed, by weight percent, 0.015%.

Preferably, the alloy has a density of 0.306 pounds per cubic inch and a melting point of approximately 2505 degrees Fahrenheit. The thickness of the coating layers 70, 72 is preferably at least 0.025 inches.

The coating has excellent wear resistance properties as well as a high degree of resistance to corrosion and other forms of environmental degradation. The coating can be easily weld-repaired, and in addition to the proposed use in a keel joint assembly, can be used in a variety of subsea oil field applications involving metal components that slide against one another, for example metal seals, ball joints and guide rods. The coating may be applied to different types of keel joints.

While the invention has been described herein with respect to a preferred embodiment, it should be understood by those that are skilled in the art that it is not so limited. The invention is susceptible of various modifications and changes without departing from the scope of the claims.

The invention claimed is:

1. A method of reducing wear on one or more subsea components that slidingly engage each other, the method comprising:

applying a coating to one or more surfaces of the components, the coating comprising a cobalt-chromium-nickel alloy, whereby the coating reduces stress and wear on the components caused by relative sliding movement of the components, wherein the coating by weight percent consists essentially of 23.5–29.0% chromium, 7.0–12.0% nickel, 3.0–6.0% molybdenum, 1.0–5.0% iron, 1.0–5.0% tungsten, 0.1–1.5% manganese, 0.05–1.00% silicon, 0.02–0.20% carbon and an amount of cobalt.

2. The method of claim 1, wherein the coating includes by weight percent no more than 0.030% phosphorus, no more than 0.020% sulfur and no more than 0.015% boron.

3. The method of claim 1, wherein the coating by weight percent consists essentially of 26.0–29.0% chromium, 8.0–12.0% nickel, 3.0–5.0% molybdenum, 0.4–1.0% tantalum, no more than 2.0% iron, 3.0–5.0% tungsten, no more than 1.0% manganese, 0.05–1.00% silicon, 0.12–0.20% carbon and the remainder cobalt.

4. The method of claim 1, wherein the coating by weight percent consists essentially of 23.5–27.5% chromium, 7.0–11.0% nickel, 4.0–6.0% molybdenum, 1.0–5.0% iron, 1.0–3.0% tungsten, 0.1–1.5% manganese, 0.05–1.00% silicon, 0.03–0.12% nitrogen, 0.02–0.10% carbon and the remainder cobalt.

5. The method of claim 1, wherein the components are located in a keel joint assembly of a riser extending to a vessel and including a partially spherical bearing element and one or more mating elements.

6. The method of claim 5, wherein a layer of the coating is disposed between a surface of the bearing element and an adjacent surface of at least one of the mating elements.

7. The method of claim 5, wherein a first layer of the coating is applied to a surface of the bearing element, and wherein a second layer of the coating is applied to an adjacent surface of at least one of the mating elements.

8. The method of claim 1, wherein the coating is applied to the components by a welding process.

9. The method of claim 1, wherein the coating has a thickness of at least 0.025 inches.

10. A method of reducing wear on an offshore riser assembly having a submerged partially spherical convex bearing element that flexes in sliding engagement with a partially spherical concave bearing element, the method comprising:

applying by a welding process a coating to each of the bearing elements, the coating consisting essentially of cobalt, chromium, nickel, molybdenum, iron and tungsten, wherein the coating by weight percent consists essentially of 23.5–29.0% chromium, 7.0–12.0% nickel, 3.0–6.0% molybdenum, 1.0–5.0% iron, 1.0–5.0% tungsten and an amount of cobalt.

11. The method of claim 10, wherein the coating further comprises one or more of the group consisting of manganese, silicon, nitrogen and carbon.

12. The method of claim 10, wherein the coating further comprises one or more of the group consisting essentially of manganese, silicon, nitrogen, phosphorus, sulfur, boron and carbon.

13. In a subsea well production assembly having first and second submerged metal components with bearing surfaces that slidingly engage each other, the improvement comprising:

a cobalt-chromium-nickel alloy coating on the bearing surface of at least one of the components wherein the coating by weight percent consists essentially of 23.5–29.0% chromium, 7.0–12.0% nickel, 3.0–6.0% molybdenum, 1.0–5.0% iron, 1.0–5.0% tungsten, 0.1–1.5% manganese, 0.05–1.00% silicon, 0.02–0.20% carbon and an amount of cobalt.

14. The improvement of claim 13, wherein the coating includes by weight percent no more than 0.030% phosphorus, no more than 0.020% sulfur and no more than 0.015% boron.

15. The improvement of claim 13, wherein the coating is applied to both of the bearing surfaces.

16. The improvement of claim 13, wherein the coating has a thickness of at least 0.025 inches.

* * * * *